US005813415A

United States Patent [19]

Slali

[11] Patent Number: 5,813,415

[45] Date of Patent: Sep. 29, 1998

[54] NAIL EASEL DETAILING AND STORAGE KIT FOR PREPARING ARTIFICIAL FINGERNAILS

[76] Inventor: Susan Slali, P.O. Box 427, Sarasota, Fla. 34230-0427

[21] Appl. No.: 45,229

[22] Filed: Mar. 21, 1998

Related U.S. Application Data

[60] Provisional application No. 60/054,974 Aug. 6, 1997.

[51] Int. Cl. [6] ..... A45D 29/00

[52] U.S. Cl. ..... 132/73; 132/73.5; 132/285; 206/581

[58] Field of Search ..... 132/73, 73.5, 75, 132/75.3, 76.2, 285, 286, 315, 319; 206/823, 581, 45.14, 45.34, 56, 45.2, 45.24, 45.25

[56] References Cited

U.S. PATENT DOCUMENTS

| | | | |
|---|---|---|---|
| 820,542 | 5/1906 | Auerbach | 206/45.2 |
| 2,868,364 | 1/1959 | Helser | 206/45.2 |
| 3,913,594 | 10/1975 | Tsukamoto | 132/76 |
| 3,916,920 | 11/1975 | Tsukamoto | 132/73 |
| 4,140,139 | 2/1979 | Aylott | 132/73 |
| 4,294,268 | 10/1981 | Kitrell | 132/73 |
| 4,696,316 | 9/1987 | Stanley | 132/73 |
| 5,277,205 | 1/1994 | Jenkins | 132/200 |
| 5,316,026 | 5/1994 | Jenkins | 132/285 |
| 5,464,029 | 11/1995 | Rentz | 132/73 |
| 5,482,057 | 1/1996 | Bushmaker | 132/73 |

*Primary Examiner*—Gene Mancene
*Assistant Examiner*—Pedro Philogene

[57] ABSTRACT

The Nail Easel Detailing and Storage Kit for applying nail polish and ornamentation to artificial fingernails, comprises a convenient durable unit (10) with an attached lid (12) having a removable easel (26) with a multitude of angles and levels to apply nail polish, enamels and artistic ornamentation to at least ten displayed artificial fingernails. Artificial fingernails are applied by releasable double-sided adhesive tabs to the nail station (32) having a specifically designed convex head, suspending a releasable fingernail. A storage compartment (20) within the base of a unit provides the opportunity to store supplies including but not limited to, artificial fingernails, decals, pinstripes, fingernail adhesive, double-sided adhesive tabs, files and buffers.

5 Claims, 5 Drawing Sheets

NAIL EASEL DETAILING AND STORAGE KIT FOR PREPARING ARTIFICIAL FINGERNAILS

BACKGROUND

Cross-References to Related Applications

Figure 1:
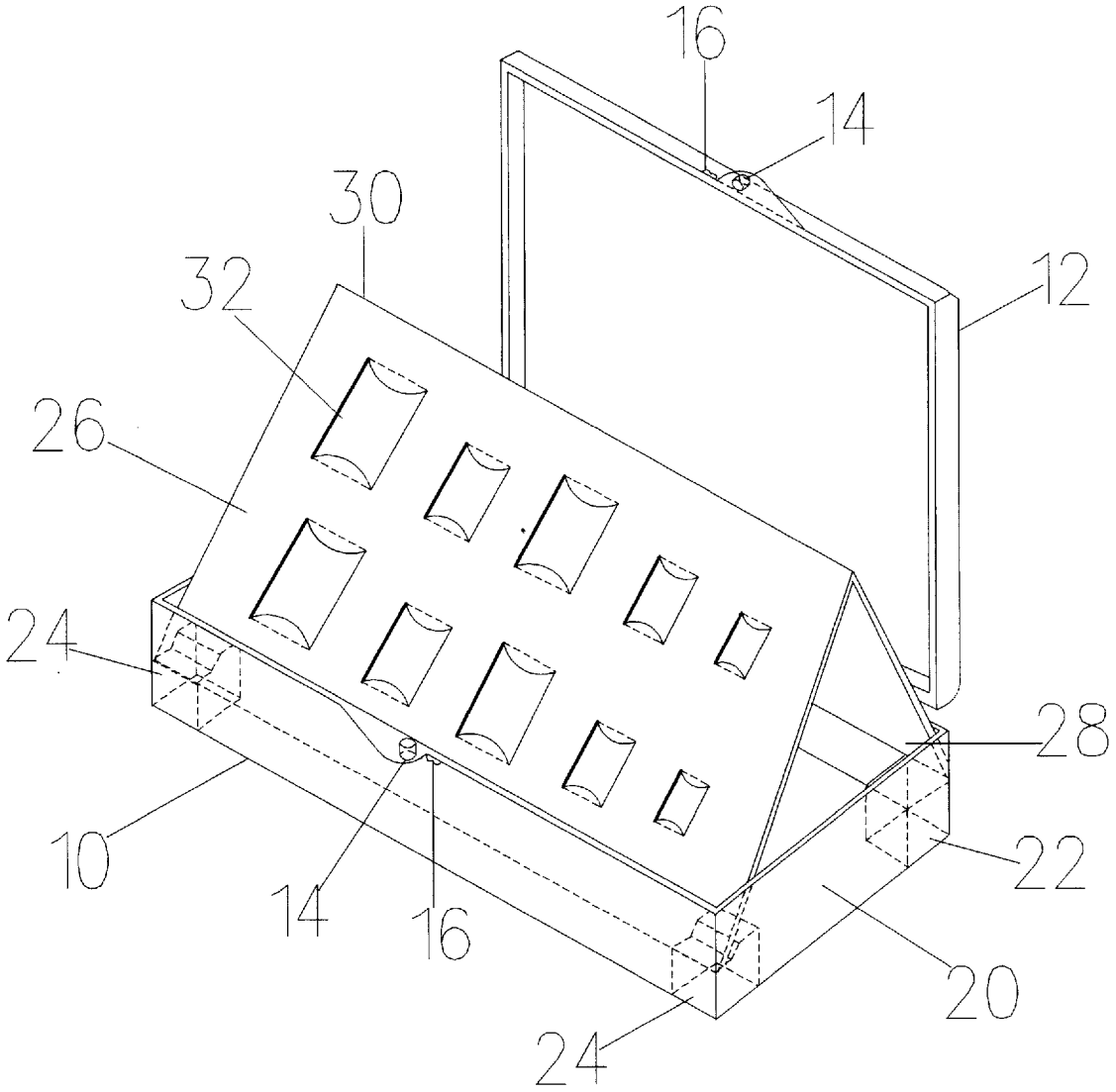

"This application claims the benefit of Provisional Patent Application, Serial #06/054974, filed 1997 Aug. 6."

Field of Invention

This invention relates to conveniently coloring, polishing or adding ornamentation, including decals or other artwork, to artificial fingernails, as well as providing a single, specific structure to store nail ornamentation supplies.

Description of Prior Art

Beauty Supply Retailers and Department Stores typically supply consumers with nail care products. Most items are commonly sold in separate categories, for example, decals and ornamentation decals in one packet and artificial fingernails in an additional package.

Consumers typically purchase artificial fingernails and adhesive to apply artificial fingernails to the natural nails. Additionally, consumers may purchase various enhancement products, including decals, rhinestones, pinstripes or other nail art products for ornamentation. The traditional sequence of events includes first sizing the artificial fingernails to a consumer's own fingertips, then adhering and adjusting the artificial nails. Upon completion, coloring polish is applied. A drying period is necessary after this step to avoid smudging the previously applied color. Only after the artificial nails are completely dried can further ornamentation be added. Further a consumer actually wears the nails while completing these processes, adding significantly to the degree of difficulty.

Previous inventors have created several types of aids to apply nail polish and nail ornamentation. U.S. Pat. No. 4,696,316 to Stanley (1986) discloses a stand for polishing artificial fingernails. However, the stand may only be used for one artificial fingernail at a time, resulting in a time consuming process. Further, the nail cannot be removed from the stand until it is completely dry. This very fact, in theory, increases nail coloring time ten fold. The article is pedestal-like in shape, and is freestanding, offering no storage compartment. In addition, the structural design features a weak area centrally located between the top convex head and the base making the article vulnerable to breakage, prohibiting results. U.S. Pat. No. 5,133,369 to Billings (1992) shows a method of applying nail art to fingernails. Using a liquid medium adapted to support a given amount of nail polish, the polish is arranged with a drop or drops of nail polish artistically arranged to create a desired design configuration. An implement such as a toothpick is lightly touched to the surface of the nail polish to move the suspended nail polish into a configuration providing the transfer of the polish to the fingernail.

Further addressing the Billing method, if the consumer wishes to apply various designs, multiple steps need to be repeated in preparing the liquid medium. Also, being relatively one container, the consumer eventually would apply the nail polish in an uncoordinated inaccurate manner to the other fingernails resulting in nail polish being applied to the skin surrounding the fingernails or having irregular designs. Finally, Billing's disclosure does not offer convenience, including, but not limited to, the lack of a storage compartment.

Although pre-polished artificial fingernails offer convenience, they lack in design choice. Pre-polished or pre-ornamented artificial fingernails are typically worn one time only. Further, artificial fingernails are inaccurate regarding size to fit over the consumer's natural fingernails. This requires the consumer to invest an extra expense and time applying ridge fillers to employ a uniform appearance whereby resulting in altering the original design on the pre-polish nail. In addition, if manual trimming is required to perfect the fit, unpainted side areas become visible and color matching for touch up is nearly impossible.

Several types of nail care devices have been proposed—for example, U.S. Pat. Nos. 3,913,594 (1975) and 3,916,920 (1975), both to Tsukamoto discloses a complex motor driven device to rotate the article, however motorized devices are prohibitively expensive to manufacture. Disclosure also reveals no storage compartment to provide the convenience of having all that is needed to accomplish ornamentation of fingernails. U.S. Pat. Nos. 5,277,205 (1994) and 5,316,026 (1994) both to Jenkins, reveals a method and apparatus for making a decorative pattern by stencils on a fingernail without storage for nail art ornamentation.

The device is operated in a manner whereby the consumer must utilize both hands to complete each fingernail. Thus, previously completed fingernails remain non-dried while the consumer attempts to continue onto other nails. As a result, smudging of previously completed fingernails will occur, providing an unfashionable and unprofessional result. It has generally been found that all previous methods for applying artificial fingernails and subsequent ornamentation suffer from these and other disadvantages, either specifically or collectively:

(a) The article of manufacture consists of motor driven articles, subject to wear and additional manufacturing expense.

(b) The shapes are generally complex in order to achieve the purpose. Present inventions in the field require specific means of manipulation to achieve maximum results. Deterioration or breakage is possible due to design and construction weakness. For example, a device having a stout base and weighty top with the connection between the two being relatively thinner, slimmer or smaller has a shorter life span. Factual knowledge will show when repeated pressure is exerted at the top, or mounting area, it will cause friction to the connection or stem-like area between the top and bottom base.

(c) Motor driven devices generally produce nuisance noise. When the device is insulated for any noise reduction, weight and the cost of manufacture would naturally increase.

(d) The performance of known devices using clamp-like adherence to the users own fingers immobilizes the consumer to work freely with both hands.

(e) Nail polishing devices are generally designed for the consumer to hold the apparatus in one hand and perform the function with the second hand. However seen, it would create an enormous effort for a consumer with a handicap to achieve any results with a device as such.

(f) A consumer, whether adult or young adult, not familiar or talented in the field may seek results from a professional salon, proven to be a costly and time consuming exercise.

(g) Current nail color and polish application devices provide no avenue to be used by a one handed person. As all such devices require two hands.

OBJECTS AND ADVANTAGES

Accordingly, several objects and advantages of a Nail Easel Detailing & Storage Kit for preparing artificial fingernails include:

(a) to provide a nail ornamentation and polishing device allowing all ten artificial fingernails to be prepared at once;

(b) to provide a nail ornamentation and polishing device capable of holding multiple artificial fingernails enabling the consumer to prepare the ornamentation having both hands available to achieve maximum results;

(c) to provide a nail ornamentation and polishing device convenient and easy to use offering multiple positions for comfort, allowing the user to achieve maximum results;

(d) to provide a nail ornamentation and polishing device constructed of easy to clean materials in the event of spillage or over-painting;

(e) to provide a nail ornamentation and polishing device constructed of heavy duty, yet light weight materials, designed without structural flaw, to promote nearly unlimited usable life;

(f) to provide a nail ornamentation and polishing device of simple design allowing users of all ages to extract maximum benefit from the product, regardless of natural talent or dexterity;

(g) to provide a nail ornamentation and polishing device capable of being used with only one hand, providing specific appeal to a handicapped or one-handed person;

(h) to provide a nail ornamentation and polishing device manually operated without motor driven devices inherently prone to heat generation and potential subsequent melting;

(i) to provide a nail ornamentation and polishing device in an aesthetically appealing carrier allowing all necessary nail ornamentation to be completely organized in one unit;

(j) to provide a nail ornamentation and polishing device that may be taken by the consumer to another destination, such as vacations, with the unit containing all that will be needed to accomplish beautiful nails while away from home;

(k) to provide a nail ornamentation and polishing device constructed of materials which are color customizable, allowing consumers a purchase choice based on preference;

(l) to provide a nail ornamentation and polishing device that is detachable from the main unit for cleaning purposes;

(m) to provide a nail ornamentation and polishing device providing a storage compartment molded into the manufactured unit to house supplies including decals, files, buffers, adhesive, tabs and a generous supply of artificial fingernails: and (n) to provide a nail ornamentation and polishing device to aid the professional salon industry by allowing the consumer to pre-size nails at a salon, select a design, and have the nails painted in the consumer's absence, enhancing convenience for the consumer.

Further objects and advantages include providing a nail ornamentation and polishing device capable of providing consumers the opportunity to save time and expense. Specifically the product allows consumer to produce and reproduce nail ornamentation in a quick and efficient manner, flawlessly ornamented and polished. The product completely eliminates the problems associated with wet and tacky enamels and lacquers and frees the consumer to prepare the nails well prior to applying the nails, thereby yielding significant convenience.

DRAWING FIGURES

FIG. 1 is a perspective view of the invention. The view is angled to show the entire unit, including a storage compartment. This view shows support post(s) molded into a base of a unit providing the positioning of an easel at one of the three attainable angles.

Figure 2:
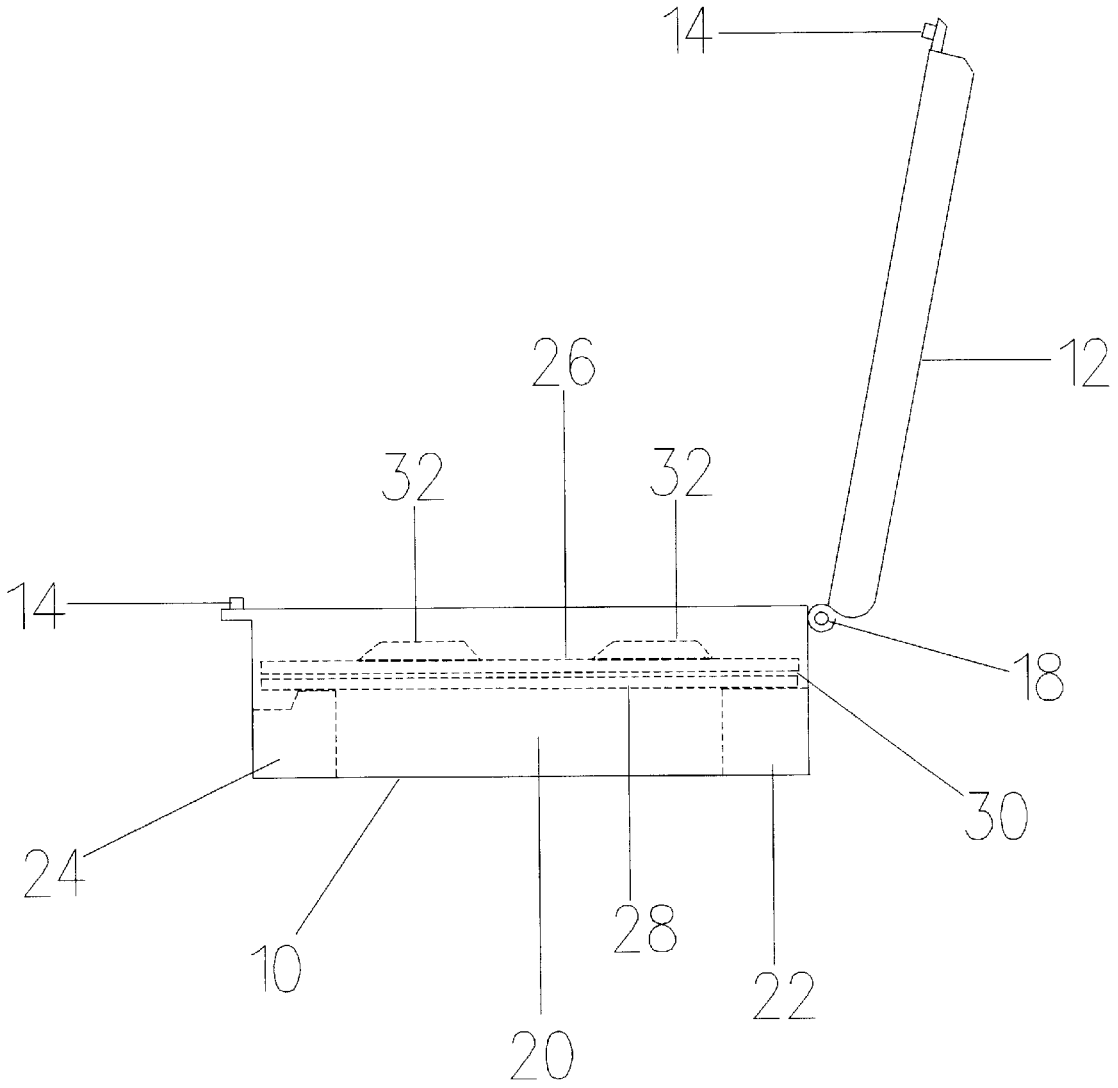

FIG. 2 is a side view of the invention. The view illustrates a removable nail easel with attached nail stations folded back face to back face in an oblate or horizontal position level. The easel rests on four support posts for maximum stability. The view illustrates an actual packaging position with the lid open.

Figure 3:
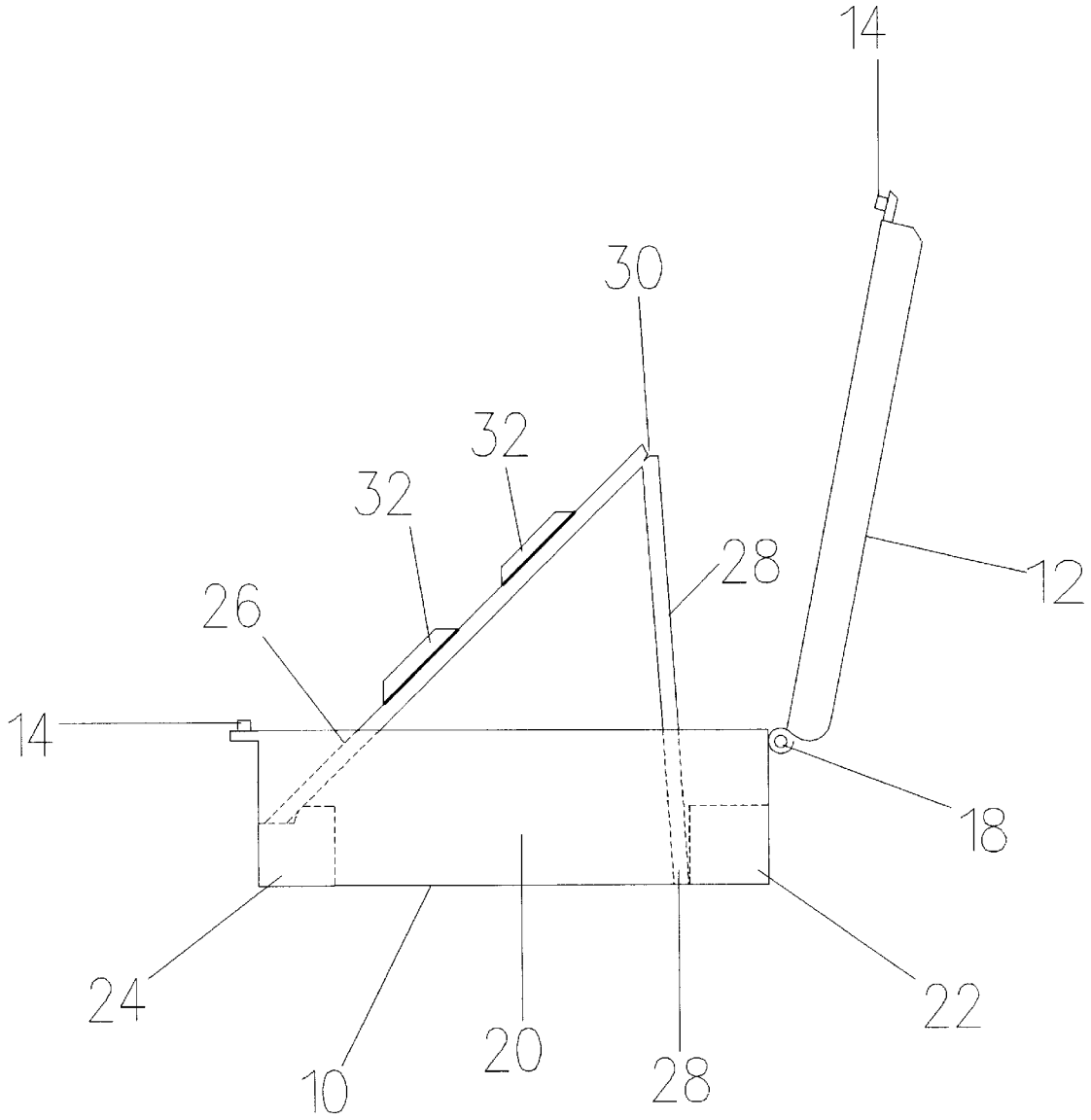

FIG. 3 is an additional side view of the invention. The view illustrates in detail a removable nail easel with attached nail stations in a second of three available positions. The rear easel support panel rests on the base of the unit, secured against the back upright face of the rear posts for maximum stability. The front portion of the nail easel unit rests atop of front support posts within the beveled seat, with the front most portion of the easel resting against the inside face of the storage compartment.

Figure 4:
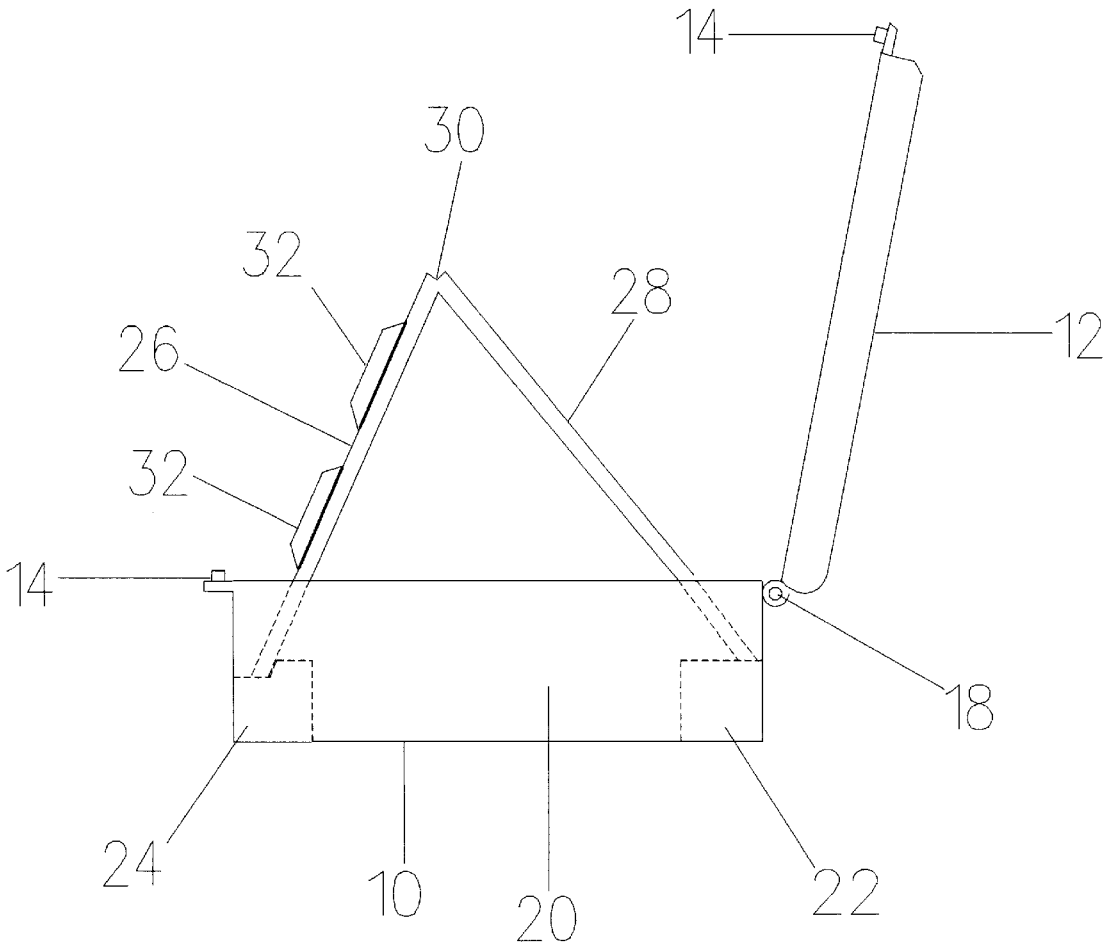

FIG. 4 is an additional side view of the invention. The view illustrates in detail a removable nail easel with attached nail stations in the third of three available positions. FIGS. 2, 3, and 4 show known detailed positioning levels or angles with the nail easel panel with attached nail stations placed at specific points. All figures illustrate the space available for a storage compartment.

Figure 5:
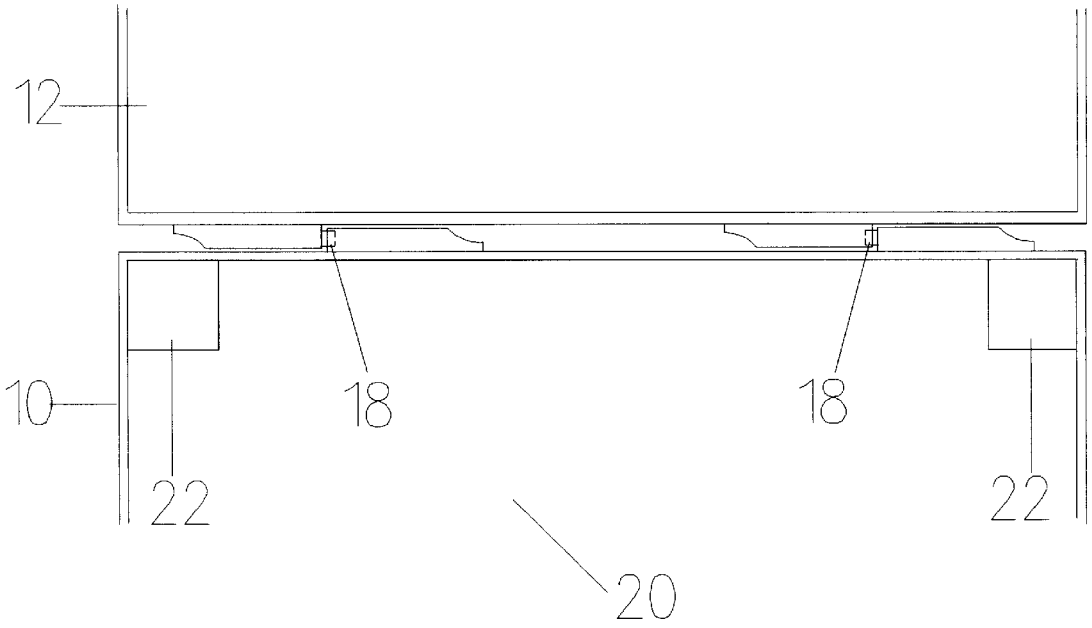

FIG. 5 is a perspective view of the inter-snapping hinge(s) with the unit opened.

REFERENCE NUMERALS IN DRAWINGS

| Reference Numeral | Part |
|---|---|
| 10 | Base of Unit |
| 12 | Lid |
| 14 | Closure Snap Tongue |
| 16 | Closure Snap Guard |
| 18 | Intersnapping Hinge(s) |
| 20 | Storage Compartment |
| 22 | Rear Support Post(s) |
| 24 | Front Support Post(s) |
| 26 | Easel Front Panel |
| 28 | Easel Support Panel |
| 30 | Living Hinge (Scored) |
| 32 | Nail Station(s) |

SUMMARY

In accordance with the present invention a Nail Easel Detailing and Storage Kit for preparing artificial fingernails includes: a rectangular unit with an opening lid; a removable nail easel with attached nail stations; molded mounting posts for three known positioning levels; and a storage compartment.

DESCRIPTION—FIGS. 1–5

FIG. 1 shows an overall view of the basic version of a Nail Easel Detailing and Storage Kit for preparing artificial fingernails. The entire unit is molded of durable polypropylene. A base unit 10 with lid 12 closed measures approximately six inches wide, four inches from front to back and one inch deep. A storage compartment 20 measures approximately 18 cubic inches located in a base unit 10. Four-support post(s) 22 and 24 are molded into four opposite comers and measure approximately ½ inch on all sides. The two farthest forward support posts 24 have a chamfer notch for stabilizing the front panel of the nail easel panel 26, securing the panel to avoid the opportunity for the nail easel panel 26 to slip backward when pressure is applied during use. The two rear support posts 22 are flat at the top, allowing the back flap of the nail easel panel 26 to be secured against the inside back wall of the base unit 10.

A base unit 10 is connected to a lid 12 by the inter-snapping hinge(s) 18 as illustrated in FIG. 5. The lid 12, when closed is snapped together to a base unit 10 by means of a closure snap tongue 14 and a closure snap guard 16, illustrated in FIG. 1.

The removable two-paneled nail easel is comprised of a front panel 26 with nail station(s) 32 molded onto the manufactured front panel 26. The rear support panel 28 is joined to the front panel 26 with a folding intersection and a connection of a living hinge (scored) 30. Ten nail stations 32 in five various sizes host artificial fingernail(s) by means of releasable double-sided adhesive tabs. Nail station(s) 32 are molded in an convex design with the highest center point of the convex mound standing approximately 3/16 of an inch above the surface of a front panel 26. The upper and lower edges of the nail station(s) 32 are beveled as illustrated in FIG. 1.

There are three known positioning levels. These include: horizontal, as illustrated in FIG. 2; reclined, as illustrated in FIG. 3; and upright, as illustrated in FIG. 4.

From the description above, a number of advantages of a Nail Easel Detailing and Storage Kit for preparing artificial fingernails are evident:

(a) The unit provides for the preparation of ten artificial fingernails at once;

(b) The storage compartment provides the opportunity to store supplies, including, but not limited to, decals, pinstripes, artificial fingernail adhesive, releasable double-sided adhesive tabs to mount the artificial fingernails upon the nail stations and fingernail filers or buffers;

(c) Various positioning levels provide comfort for the user;

(d) The nail easel portion with attached nail stations is removable, allowing easy cleaning;

(e) The compact unit is specifically designed for ease of transport to other destinations, including vacations;

(f) The rectangular shape of the unit in the figures shown is considered to be the basic design and may consist of various shapes, sizes and/or colors; and (g) Young adults and handicapped users easily employ the specific simple design.

OPERATION—FIGS. 1, 2, 3, 4, 5

A Nail Easel Detailing and Storage Kit is a self-contained device designed to prepare artificial fingernails with nail enamel, lacquer, polish and/or nail art. The sequence of operation employed to use a Nail Easel Detailing and Storage Kit includes a series of steps to prepare the artificial fingernails for application to the user's own fingertips. As illustrated in FIG. 2, the case is opened and the removable easel (26) with back support panel (28) lies flat within the case. The storage unit area (20) is clearly secured in this configuration.

The consumer fits and files the artificial fingernails to their own fingertips. Once the nails are correctly filed to match the user's fingertip profile, the ten artificial fingernails are adhered to the convex molded nail stations (32). This is accomplished using releasable double-sided adhesive tabs. The consumer places the front portion of the nail easel panel (26) in the position level that is most comfortable for applying polish and adornment to the fingertips. The angle of the nail easel panel is adjusted by placing the rear nail easel panel (28) in either the high or low position, against, or atop, the rear support posts (22). The front easel panel (26) is placed into a chamfer notch in the front support post (24). This prevents the front panel (26) from being pushed backward if pressure is applied. Alternatively, the user may place the folded nail easel panel (26) flat atop the front (24) and rear (22) sets of support posts. FIGS. 2, 3, and 4 clearly outline the various positioning levels.

The nail stations (32) are molded with convexity whereby the top of the nail station (32) is raised approximately 3/16 of an inch off the surface of the nail easel panel (26). A convex nail station (32) provides for the artificial fingernail(s) to be entirely polished on both the front and the sides. The specific design of the molded nail station (32) being beveled at the top and bottom edges as shown in FIG. 1 provides for easy removal of the artificial fingernail after adornment.

Upon completion of the polish application step, the nails will air dry on the front easel panel (26). The user may then opt to enhance the nails through the use of additional adornment including decals, pinstripes, or airbrush art, if desired. With all ten artificial fingernails being displayed in such a manner, the opportunity for consistency of placement of adornment features is greatly enhanced as all nails are viewed as a group.

Upon completion of all adornment steps, the completed artificial fingernail(s) are easily removed from the front heightened nail stations (32). The consumer then peels away any remaining releasable double-sided adhesive tabs. Using artificial fingernail tip adhesive, the user applies the completed artificial fingernail over their own natural fingernail tip.

After applying the dried and prepared artificial fingernail (s), supplies such as nail adhesive, releasable double-sided adhesive tabs, files, buffers, decals and other desirable nail art products may be placed in an organized manner in the storage compartment at the base unit (10).

The closure snap tongue (14) snaps into the snap guard (16) keeping all contents secure when the lid (12) is in a closed position.

The inter-snapping hinges (18), molded opposite the closure snap tongue (14) or latch allow the lid (12) to open at an angle of more than 180 degrees. This feature allows the lid (12) to be completely out of the way when preparing artificial fingernail(s).

CONCLUSION, RAMIFICATIONS, AND SCOPE

Accordingly, an adult, young adult or handicapped can use a Nail Easel Detailing and Storage Kit for preparing artificial fingernails with extreme ease. Further, a Nail Easel Detailing and Storage Kit provides significant advantages including:

Allowing consumers of all ages to prepare their own artwork to artificial fingernail(s) with extreme ease by having the use of both hands;

Reasonable cost efficiency considering the costs of salon-prepared nails;

Considerable time saving for the consumer by not having artificial fingernails actually applied to their own fingers while applying polish and adornment. Consequently, the consumer does not have to wait until the nails dry on their own fingers prior to proceeding;

Provides ease of use to a user if handicapped or one-handed;

Provides the convenience of having all associated nail adornment supplies available in one central location within the storage compartment built into the base of the unit;

Allows the user to take the unit to another designation such as vacations;

Provides a removable working easel panel, able to be cleaned with nail polish remover or acetone should spillage occur.

Although the aforementioned description is specific, it should not be construed as limiting the scope of the invention but more so for providing an illustration of the application and use of the unit.

For example, a Nail Easel Detailing and Storage Kit can have other shapes, including circular, oval, trapezoidal, triangular, shell-like, diamond, etc. A unit may also be molded of polyethylene, vinyl, acrylic, various impregnated or laminated fibrous materials, or various plastic materials with or without color. The easel's rear support panel may take the form of foldable rods or post(s). Supporting posts may have other shapes or forms, including the application of suction cups to the base of the easel panels, which may be positioned on shelf like beams spanning the entire base of the unit. The entire unit may measure smaller or larger than the approximate sizes specified. A Nail Easel Detailing and Storage Kit may be molded in color materials, using either solids or patterns.

Thus the scope of the invention should be determined not by the embodiment(s) illustrated, but by the appended claims and their legal equivalents.

What is claimed is:

1. A convenient, self-contained appliance allowing the user to apply nail polish and ornamentation to a multitude of artificial fingernails, comprising:

a case of durable, washable material of sufficient size to provide a storage area for nail polishing and ornamentation supplies with a detachable lid and sufficient number of support posts secured into the bottom surface of the case for supporting, elevating and positioning the nail polish and ornamentation application device;

wherein at least two forward said support posts having at least one set of parallel, indented grooves for supporting and positioning the nail polish and ornamentation application device;

a removable nail polish and ornamentation application device having a front and a rear panel with a multitude of secured, convexed nail members of substantially disparate dimensions to mimic the structure and dimension of at least a full set of human fingernails attached to a full, flat surface of said panel;

said members are specifically shaped and dimensioned to receive and retain at least a full set of artificial fingernails and provide elevation of at least a full set of artificial fingernails for precision polishing and ornamentation.

2. A nail polish and ornamentation application device having a multitude of secured convexed members as recited in claim 1, wherein means for adhering artificial fingernails comprises double-sided adhesive tabs, one side being attached to said members, and the opposite side retaining the artificial fingernail.

3. A nail polish and ornamentation application device with said secured convexed members as recited in claim 2, having at least three positioning levels comprising a rear panel as well as a front panel being positioned at a multitude of desired levels and angles for ease of use.

4. A nail polish and ornamentation appliance device as recited in claim 3, with attached suspended artificial fingernails arranged on said members by means of said tabs to create an artistically desired design directly upon said fingernails.

5. Said members as recited in claim 4, having incurvated tip edges of said members for means of easy removal of said fingernails after allowing artificial fingernails to dry whereby a user may apply polished and ornamented dried artificial fingernails at their convenience.

* * * * *